US008884545B2

(12) United States Patent
Lin et al.

(10) Patent No.: US 8,884,545 B2
(45) Date of Patent: Nov. 11, 2014

(54) LED DRIVING SYSTEM AND DRIVING METHOD THEREOF

(75) Inventors: Song-Yi Lin, Hsinchu County (TW); Hsuan-I Pan, Hsinchu County (TW); Hung I Wang, Hsinchu County (TW)

(73) Assignee: MStar Semiconductor, Inc., Hsinchu Hsien (TW)

( * ) Notice: Subject to any disclaimer, the term of this patent is extended or adjusted under 35 U.S.C. 154(b) by 751 days.

(21) Appl. No.: 13/176,131

(22) Filed: Jul. 5, 2011

(65) Prior Publication Data

US 2012/0098441 A1 Apr. 26, 2012

(30) Foreign Application Priority Data

Oct. 26, 2010 (TW) ..... 99136448 A

(51) Int. Cl.
*H05B 37/02* (2006.01)
*H05B 33/08* (2006.01)

(52) U.S. Cl.
CPC ..... *H05B 33/0827* (2013.01); *H05B 33/0818* (2013.01)
USPC ..... 315/291; 315/195; 315/198

(58) Field of Classification Search
USPC ..... 315/291, 186, 193, 194–199
See application file for complete search history.

(56) References Cited

U.S. PATENT DOCUMENTS

| | | | | |
|---|---|---|---|---|
| 7,961,158 | B2 * | 6/2011 | Chou et al. | 345/82 |
| 8,044,609 | B2 * | 10/2011 | Liu | 315/291 |
| 2004/0208011 | A1 * | 10/2004 | Horiuchi et al. | 362/458 |
| 2011/0084620 | A1 * | 4/2011 | Lee | 315/186 |
| 2011/0121761 | A1 * | 5/2011 | Zhao | 315/312 |

FOREIGN PATENT DOCUMENTS

| | | |
|---|---|---|
| CN | 101080119 | 11/2007 |
| TW | 200820826 A | 5/2008 |
| TW | 200939877 A | 9/2009 |
| TW | 201008376 A | 2/2010 |

* cited by examiner

*Primary Examiner* — Tuyet Vo
*Assistant Examiner* — Henry Luong
(74) *Attorney, Agent, or Firm* — WPAT, PC; Justin King

(57) ABSTRACT

A light emitting diode (LED) driving system drives a plurality of LED strings. A plurality of current sources are respectively connected to the plurality of LED strings. A multi-phase control signal generator generates a plurality of multi-phase control signals that respectively maintain turn on or turn off states of the current sources so as to selectively conduct the corresponding LED strings.

14 Claims, 5 Drawing Sheets

LED DRIVING SYSTEM AND DRIVING METHOD THEREOF

CROSS REFERENCE TO RELATED PATENT APPLICATION

This patent application is based on Taiwan, R.O.C. patent application No. 099136448 filed on Oct. 26, 2010.

FIELD OF THE INVENTION

The present invention relates to a light emitting diode (LED) driving system, and more particularly, to an LED driving system that controls an LED via a multi-phase control signal.

BACKGROUND OF THE INVENTION

Since an LED has many advantages including small volume, short response time, low power consumption, high reliability, and high mass-production feasibility, the LED is widely applied as a light source in various electronic devices. For example, the LED serves as a backlight source of a liquid crystal display (LCD) to replace a conventional fluorescent tube.

FIG. 1A shows a conventional LED driving system mainly comprising a plurality of LED strings 10, a minimum voltage selector 12, a boost controller 14, and a boost power stage circuit 14.

For the conventional LED driving system illustrated in FIG. 1, although every LED string 10 implements the same voltage source $V_{DC}$ and the same number of LEDs 100, the LEDs 100 in each LED string may not match with one another, where voltages at input pads 11 are different. Therefore, in order to reduce power consumption of the LED strings 10, the minimum voltage selector 12 is configured to select a minimum voltage and the boost controller 14 and the boost power stage circuit 16 control a voltage source $V_{DC}$, so that the voltages at the input pads 11 are regulated at the minimum voltage.

The conventional LED driving system illustrated in FIG. 1A allows the current sources $I_S$ to turn on and turn off via a light modulation signal pulse-width modulation (PWM), which simultaneously controls to turn on or turn off the boost controller 14. In addition, when the boost controller 14 is turned off, the boost power stage circuit 16 is turned off; otherwise, a sharp overshoot voltage would occur for the outputted voltage source $V_{DC}$.

FIG. 1B shows a schematic diagram of waveforms of the light modulation signal PWM and the voltage source $V_{DC}$. Although overshoot voltage does not occur in the voltage source $V_{DC}$, when the light modulation signal PWM is at a logical-low level state (or is turned off), $V_{DC}$ undergoes a falling transient that is created due to capacitors and resistors in the system, thereby causing an unstable load current of the boost power stage circuit 16. As a result, currents flowing on the LED strings 10 and voltages at the input pads 11 are unregulated.

Therefore, a novel light modulation mechanism is in need to regulate the LED driving system.

SUMMARY OF THE INVENTION

In view of the foregoing issues, according to an embodiment of the present invention, in addition to reducing power consumption, an LED driving system regulates an overload current of a power stage circuit, a current flowing through an LED string, and a voltage at an input pad.

According to an embodiment of the present invention, an LED driving system comprises a plurality of current sources and a multi-phase control signal generator. The plurality of current sources are respectively connected to a plurality of LED strings. The multi-phase control signal generator generates a plurality of multi-phase control signals for respectively controlling to turn on or turn off the plurality of current sources, so as to either conduct or not conduct the corresponding plurality of LED strings.

DETAILED DESCRIPTION OF THE PREFERRED EMBODIMENT

Figure 2:
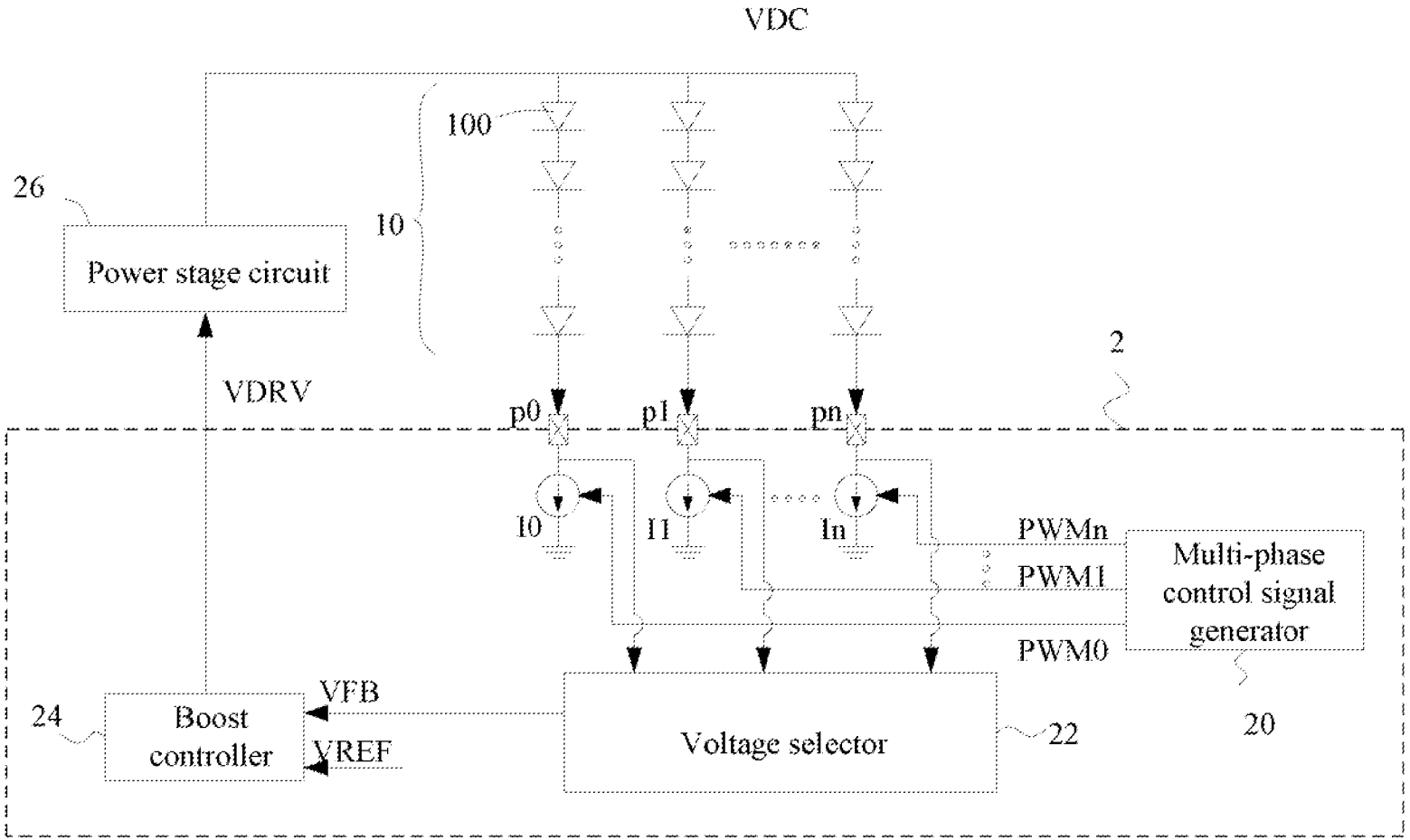
FIG. 2 is a schematic diagram of an LED driving system in accordance with an embodiment of the present invention.

FIG. 2 shows a schematic diagram of an LED driving system in accordance with an embodiment of the present invention. The LED driving system for driving a plurality of LED strings 10 can be applied to a backlight module of a liquid crystal display (LCD), for example. In this embodiment, the LED driving system comprises a plurality of current sources I0—In and a multi-phase control signal generator 20. The current sources I0—In are connected to a respective one of the LED strings 10. Each LED string comprises a plurality of LEDs 100 connected in serial. The anode of the outermost LED of each LED string 10 is connected to a voltage source $V_{DC}$, and a cathode of the innermost LED is connected to one of the input pads p0~pn of an integrated circuit (IC) 2.

In this embodiment, the LED driving system further comprises a voltage selecting circuit 22, a boost controller 24, and a power stage circuit 26. The plurality of current sources I0~In, the multi-phase control signal generator 20, the voltage selecting circuit 22, and the boost controller 24 are integrated to the IC 2, and the power stage circuit 26 is disposed outside the IC 2. However, whether the circuit blocks of the LED driving system are integrated into a single chip is dependent on different design choices, and is not limiting to the invention.

Figure 3:
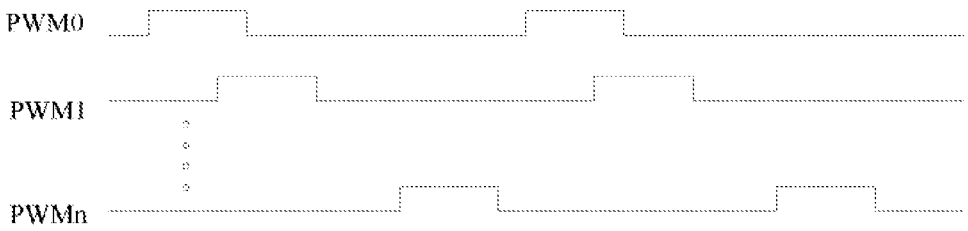
FIG. 3 is a multi-phase control signal in accordance with an embodiment of the present invention.

The multi-phase control signal generator 20 generates a plurality of multi-phase control signals PWM0~PWMn, for respectively controlling turn-on or turn-off of the plurality of current sources I0~In, so as to selectively conduct the corresponding LED strings 10. In this embodiment, the multi-phase control signals PWM0 to PWMn phases are different from one another. As shown in FIG. 3, at least some of the multi-phase control signals PWM0 to PWMn have different phases. In FIG. 3, turn-on time of at least two adjacent multi-phase control signals are partially overlapped, but is not limited thereto. Moreover, the present invention is not limited to the time sequence of logical high levels as shown in this embodiment. By utilizing the multi-phase control signals PWM0~PWMn, time periods for turning on and turning off the current sources I0~In are interleaved in time. This configuration regulates load current of the power stage circuit 26, as well as currents on the LED strings 10 and voltages at the input pads p0~pn.

Figure 4:
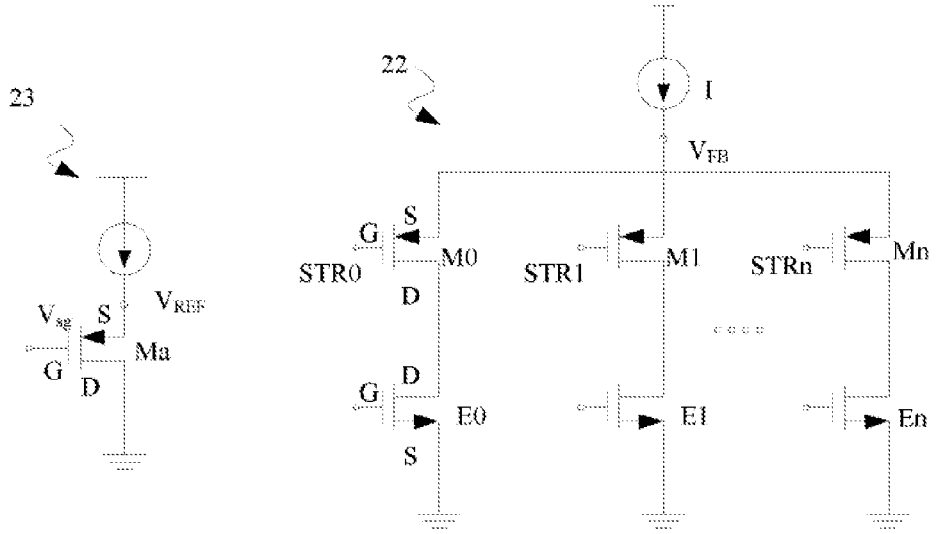
FIG. 4 is a schematic diagram of detailed circuits of a voltage selecting circuit in accordance with an embodiment of the present invention.

The voltage selecting circuit 22 is connected to the LED strings 10 and receives a plurality of voltages between the plurality of LED strings 10 and the plurality of current sources I0~In, such as the voltages at the input pads p0 to pn. The voltage selecting circuit 22 then selects one of the voltages as a selected voltage in order to output a feedback voltage $V_{FB}$ accordingly so as to regulate the voltage source $V_{DC}$ or the voltages at the input pads p0 to pn via negative feedback in association with the boost controller 24 and the power stage circuit 26. FIG. 4 shows a schematic diagram of a voltage selecting circuit 22 in accordance with an embodiment of the present invention. In this embodiment, the voltage selecting circuit 22 comprises a plurality of transistor switch pairs connected in parallel. Each transistor switch pair comprises a first transistor (M0/M1/ . . . /Mn) and a second transistor (E0/E1/ . . . /En). The first transistor (M0/M1/ . . . /Mn) receives one of the voltages at the input pads (p0/p1/ . . . /pn), and the feedback voltage $V_{FB}$ is approximately equal to a sum of the selected voltage and the threshold voltage (i.e., voltage that allows the transistor to conduct) of the first transistor (M0/M1/ . . . /Mn). Referring to FIG. 4, each first transistor (M0/M1/ . . . /Mn) is preferably a P-channel metal-oxide-semiconductor (PMOS) transistor, which has a gate G connected to voltage (STR0/.STR1/ . . . /STRn) at corresponding input pad (p0/p1/ . . . /pn). Sources of the PMOS transistors M0 to Mn are connected to output the feedback voltage $V_{FB}$. The second transistor (E0/E1/ . . . /En) is connected in serial to the one corresponding first transistor (M0/M1/ . . . /Mn) as a pair. The second transistor is conducted after having received an enable signal. For example, the enable signal is a constant voltage. In another embodiment, the second transistor (E0/E1/ . . . /En) is selectively conducted by receiving a multi-phase control signal PWM0/PWM1/ . . . /PWMn. Referring to FIG. 4, each second transistor (E0/E1/ . . . /En) is an N-channel metal-oxide-semiconductor (NMOS) transistor, which has a gate G that is controlled by the corresponding multi-phase control signal PWM0/PWM1/ . . . /PWMn.

The reference voltage generator 23 shown in FIG. 4 generates a reference voltage $V_{REF}$ to the boost controller 24. In this embodiment, the reference voltage generator 23 comprises a PMOS reference transistor Ma, which has a source S connected to the current source I and provides the reference voltage $V_{REF}$, and a gate G receiving a predetermined voltage $V_R$ that represents a desired regulated voltage of the input pads p0~pn. The selected voltage can be different from or the same as the feedback voltage $V_{FB}$. The predetermined voltage $V_R$ is different from or the same as the reference voltage $V_{REF}$.

One of the PMOS transistors (M0/M1/ . . . /Mn) receiving the selected voltage is conducted, and the other transistors are not conducted. At this point, the voltage at the source S (i.e., the feedback voltage $V_{FB}$) is equal to a sum of the selected voltage and a source-gate voltage $V_{sg}$. In addition, the voltage (i.e., the reference voltage $V_{REF}$) at the source S of the PMOS reference transistor Ma is equal to a sum of the predetermined voltage $V_R$ and the source-gate voltage $V_{sg}$. Since the feedback voltage $V_{FB}$ and the reference voltage $V_{REF}$ have $V_{sg}$ components, when the feedback voltage $V_{FB}$ and the reference voltage $V_{REF}$ feed back to the boost controller 24 for comparison, the $V_{sg}$ components are eliminated so that the selected voltage at the input pads p0 to pn are regulated to the predetermined voltage $Y_R$.

Figure 5:
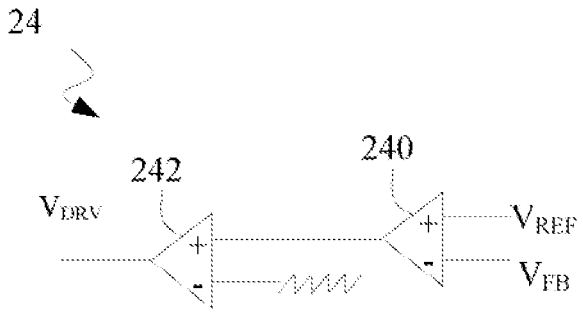
FIG. 5 is a schematic diagram of detailed circuits of a boost controller in accordance with an embodiment of the present invention.

FIG. 5 shows a schematic diagram of detailed circuits of a boost controller 24 in accordance with an embodiment of the present invention. The boost controller 24 generates a driving signal $V_{DRV}$ according to a reference voltage $V_{REF}$ and a feedback voltage $V_{FB}$. The boost controller 24 comprises a first comparator 240 that receives and compares the reference voltage $V_{REF}$ with the feedback voltage $V_{FB}$. An output of the first comparator 240 is fed into second comparator 242 to be compared with a saw wave to output a driving signal $V_{DRV}$ having a square waveform. The driving signal $V_{DRV}$ has a duty cycle that is proportional to a difference between the reference voltage $V_{REF}$ and the feedback voltage $V_{FB}$.

Figure 1A:
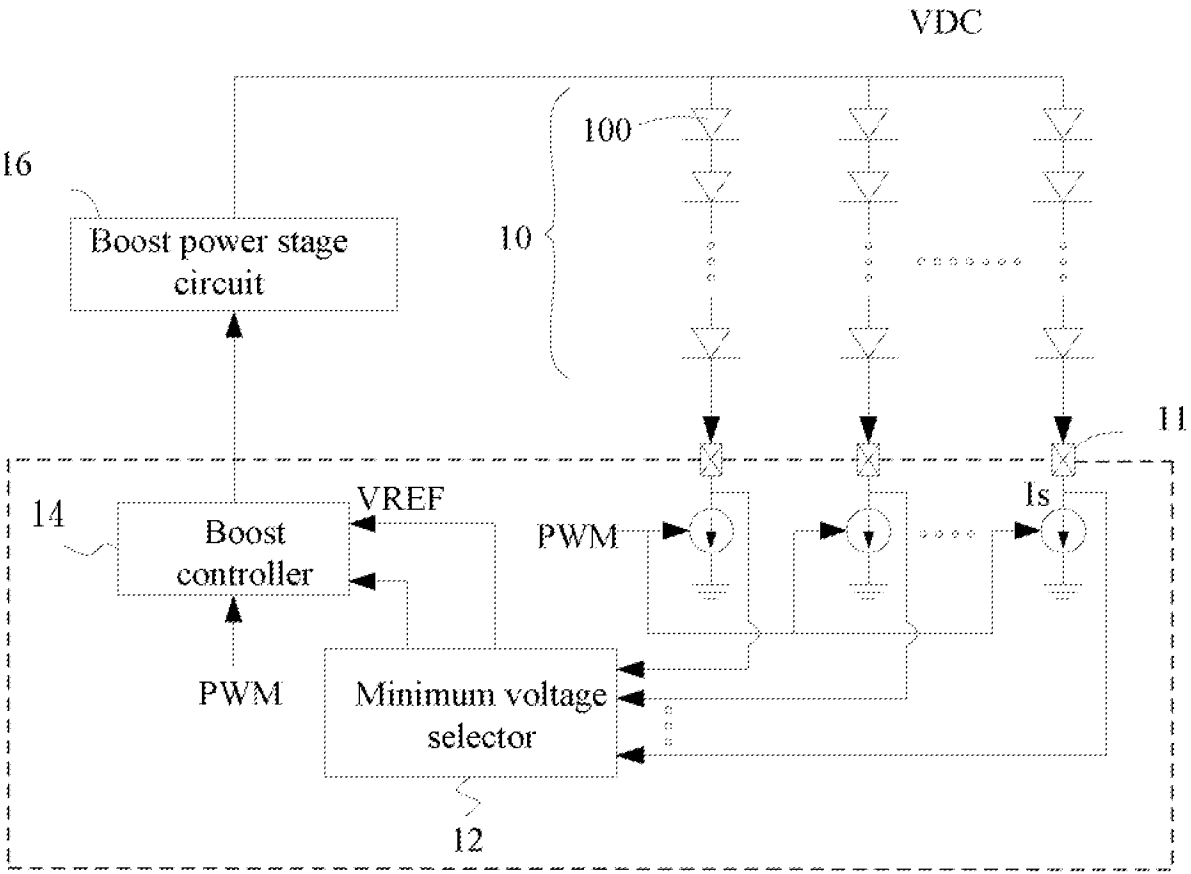
Figure 1A (Prior Art)
FIG. 1A is a schematic diagram of a conventional LED driving system.
Figure 1B:
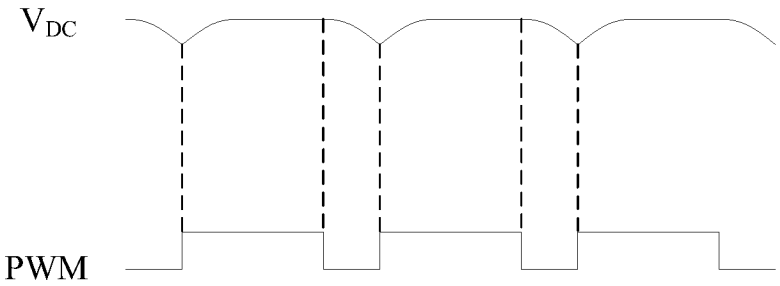
Figure 1B (Prior Art)
FIG. 1B is a schematic diagram of waveforms of a light modulation signal and a voltage source.

The power stage circuit 26 is controlled by the driving signal $V_{DRV}$. The voltage source $V_{DC}$ is adjusted by adjusting the duty cycle of the driving signal $V_{DRV}$ to regulate the selected voltage at the input pads p0~pn at the predetermined voltage $Y_R$. In the conventional LED driving system shown in FIG. 1 A, the conventional power stage circuit 16 turns on and turns off frequently, while the power stage circuit 26 in this embodiment of the present invention maintains a turned-on state.

Figure 6:
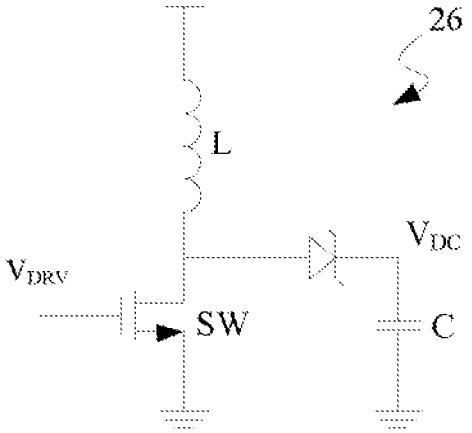
FIG. 6 is a schematic diagram of detailed circuits of a power stage circuit in accordance with an embodiment of the present invention.

FIG. 6 shows a schematic diagram of detail of circuitry of a power stage circuit 26 in accordance with an embodiment of the present invention. In this embodiment, the power stage circuit 26 serves as a boost power stage circuit, but this is not a limitation of the present invention. The power stage circuit 26 is a switching power supply mainly comprising an NMOS switching transistor (SW) and a circuit formed by an inductor L and/or a capacitor C that stores energy. The NMOS SW is connected by a driving signal $V_{DRV}$ to perform power switching.

As mentioned above, through a multi-phase light modulation mechanism of the multi-phase control signal generator 20, the sustained load and current of the power stage circuit 26 is more stable than that of the conventional LED driving system, and the currents on the LED strings and the voltages at the input pads p0~pn can be maintained in a stable state. In addition, due to the negative feedback mechanism of the voltage selecting circuit 22 and the boost controller 24, the selected voltage at the input pads p0~pn is regulated to the predetermined voltage $Y_R$.

While the invention has been described in terms of what is presently considered to be the most practical and preferred embodiments, it is to be understood that the invention needs not to be limited to the above embodiments. On the contrary, it is intended to cover various modifications and similar arrangements included within the spirit and scope of the appended claims which are to be accorded with the broadest interpretation so as to encompass all such modifications and similar structures.

What is claimed is:

1. A light emitting diode (LED) driving system, for driving a plurality of LED strings, comprising:

a plurality of current sources, respectively connected to the LED strings;

a multi-phase control signal generator, for generating a plurality of multi-phase control signals that respectively control turn-on or turn-off of the current sources so as to selectively conduct current through the LED strings; and a voltage selecting circuit, for receiving a plurality of voltages between the LED strings and the current sources, and selecting one of the voltages as a selected voltage to output a corresponding feedback voltage, comprising;

a plurality of transistor switch pairs connected in parallel;

wherein each transistor switch pair comprises:

a first transistor for receiving one the voltages, es, and the feedback voltage is substantially equal to a sum of the selected voltage and a threshold conduct voltage of the first transistor; and a second transistor connected in serial to the first transistor, wherein each second transistor is selectively conducted by receiving one of the multi-phase control signals.

2. The LED driving system as claimed in claim 1, wherein turn-on time of at least two of the multi-phase control signals are partially overlapped.

3. The LED driving system as claimed in claim 1, wherein each transistor switch pair further comprises a second transistor connected in serial to the first transistor, and each second transistor is conducted by receiving an enable signal.

4. The LED driving system as claimed in claim 1, wherein each first transistor is a P-channel metal-oxide-semiconductor (PMOS) transistor, which has a gate for receiving one of the voltages, and sources of the PMOS transistors are connected together to output the feedback voltage.

5. The LED driving system as claimed in claim 4, wherein each second transistor is an N-channel metal-oxide-semiconductor (NMOS) transistor, which has a gate controlled by one of the multi-phase control signals.

6. The LED driving system as claimed in claim 1, further comprising a reference voltage generating circuit, for generating a reference voltage.

7. The LED driving system as claimed in claim 6, wherein the reference voltage generating circuit comprises a PMOS reference transistor, which has a source providing the reference voltage and a gate receiving a predetermined voltage.

8. The LED driving system as claimed in claim 6, further comprising a boost controller, for generating a driving signal according to the reference voltage and the feedback voltage, wherein the driving signal has a duty cycle proportional to a difference between the reference voltage and the feedback voltage.

9. The LED driving system as claimed in claim 8, wherein the boost controller comprises:

a first comparator, for comparing the reference voltage with the feedback voltage; and a second comparator, for comparing an output of the first comparator and a saw wave to output the driving signal accordingly.

10. The LED driving system as claimed in claim 8, further comprising a power stage circuit comprising a switching power supply that switches according to the driving signal.

11. The LED driving system as claimed in claim 1, wherein at least a part of the multi-phase control signals have different phases.

12. A driving method, for driving a plurality of LED strings, comprising:

generating a plurality of multi-phase control signals; and respectively driving the LED strings according to the multi-phase control signals receiving a plurality of voltages of the LED strings;

selecting one of the voltages by connecting a second transistor to the transistor in serial, and the second transistor being selectively conducted by receiving one of the plurality of multi-phase control signals; and outputting a feedback voltage according to the selected voltage.

13. The method as claimed in claim 12, wherein a part of the LED strings are simultaneously maintained in a turned-on state.

14. The method as claimed in claim 12, wherein the step of selecting one of the voltages comprises:

providing a transistor, having a conduct voltage substantially equal to a difference between the feedback voltage and the selected voltage.

* * * * *